US005649650A

United States Patent [19]

Klauke

[11] Patent Number: 5,649,650

[45] Date of Patent: Jul. 22, 1997

[54] LIQUID CONTAINING PACKAGE WITH SNAP FIT NON-ROTATING SPOUT INSERT

[75] Inventor: Christian W. Klauke, Toledo, Ohio

[73] Assignee: Owens-Illinois Plastic Products Inc., Toledo, Ohio

[21] Appl. No.: 567,438

[22] Filed: Dec. 5, 1995

Related U.S. Application Data

[63] Continuation of Ser. No. 242,923, May 16, 1994, abandoned.

[51] Int. Cl.[6] ..... B65D 25/40

[52] U.S. Cl. ..... 222/570

[58] Field of Search ..... 222/109, 111, 222/570, 571, 569, 153.01; 215/321, 363; 220/306; 285/330, 921

[56] References Cited

U.S. PATENT DOCUMENTS

| | | | |
|---|---|---|---|
| 4,126,338 | 11/1978 | Coel et al. | 285/330 |
| 4,550,862 | 11/1985 | Barker et al. | 222/109 |
| 4,653,676 | 3/1987 | Stull | 285/921 |
| 4,671,421 | 6/1987 | Reiber et al. | 215/528 |
| 4,706,829 | 11/1987 | Li | 222/569 |
| 4,863,067 | 9/1989 | Krall | 222/111 |
| 4,887,746 | 12/1989 | Dubach | 222/571 |
| 4,890,768 | 1/1990 | Robinson | 222/109 |
| 4,890,770 | 1/1990 | Hagg et al. | 272/571 |
| 4,917,269 | 4/1990 | Fuchs et al. | 222/109 |
| 5,058,772 | 10/1991 | Moore et al. | 222/571 |
| 5,060,827 | 10/1991 | Segati | 222/571 |
| 5,275,312 | 1/1994 | Labruzzo | 222/570 |

FOREIGN PATENT DOCUMENTS

| | | | |
|---|---|---|---|
| 1815685 | 6/1970 | Germany | 285/330 |

*Primary Examiner*—Philippe Derakshani

[57] ABSTRACT

A liquid containing and dispensing package comprising a plastic container having a finish defining an opening. The finish has an outer surface and an inner surface. At least two annular rows of circumferentially spaced lugs are provided on the outer surface of the finish. The lugs in one row are staggered circumferentially with respect to the lugs of an adjacent row. A spout is provided and has an annular outer wall, an annular inner wall and an integral portion connecting the annular walls. The outer wall of the insert has an inner surface with two rows of spaced recesses for receiving the lugs on the finish. The inner wall of the spout has an inner surface formed with a spiral thread receiving groove. The insert includes an axially extending spout connected to the lower edge of said inner wall and extending above the inner wall. A combined measuring cup and closure is provided and has an annular axial wall and a base wall and a radial flange intermediate the base wall and lower end of the axial wall. The portion of the axial wall of the combined measuring cup and closure beneath the flange includes threads on the outer surface thereof engaging the spiral thread groove on the insert.

18 Claims, 3 Drawing Sheets

LIQUID CONTAINING PACKAGE WITH SNAP FIT NON-ROTATING SPOUT INSERT

This application is a continuation of application Ser. No. 08/242,923 filed May 16, 1994, now abandoned.

This invention relates to liquid containing and dispensing packages.

BACKGROUND AND SUMMARY OF THE INVENTION

In one type of liquid containing and dispensing package utilized, for example, in dispensing of liquid detergent a plastic container is provided with a spout and a combined measuring cup and closure is provided on the container. Typical patents showing various constructions are U.S. Pat. Nos. 4,671,421, 4,706,829, 4,863,067, 4,917,269 and U.S. Pat. No. 4,890,768.

Among the objectives of the present invention are to provide a liquid containing and dispensing package wherein the package can be easily assembled; wherein the part forming the spout can be inserted in the container and held in place utilizing various attaching methods; wherein the portion forming the spout can be pushed in and snapped in to place on the container; wherein the spout is radially prevented from rotating relative to the container, being removed from the container or taken off of the container by over-tightening of the closure; and where the combined measuring cup and closure seals against the spout and the spout seals against the container.

In accordance with the invention, the liquid containing and dispensing package comprises a plastic container having a finish defining an opening. The finish has an outer surface and an inner surface. At least two annular rows of circumferentially spaced lugs are provided on the outer surface of the finish. The lugs in one row are staggered circumferentially with respect to the lugs of an adjacent row. A spout is provided and has an annular outer wall, an annular inner wall and an integral portion connecting the annular walls. The outer wall of the insert has an inner surface with two rows of spaced recesses for receiving the lugs on the finish. The inner wall of the spout has an inner surface formed with a spiral thread receiving groove. The insert includes an axially extending spout connected to the lower edge of said inner wall and extending above the inner wall. A combined measuring cup and closure is provided and has an annular axial wall and a base wall and a radial flange intermediate the base wall and lower end of the axial wall. The portion of the axial wall of the combined measuring cup and closure beneath the flange includes threads on the outer surface thereof engaging the spiral thread groove on the insert.

DETAILED DESCRIPTION OF THE PREFERRED EMBODIMENT

Figure 1:
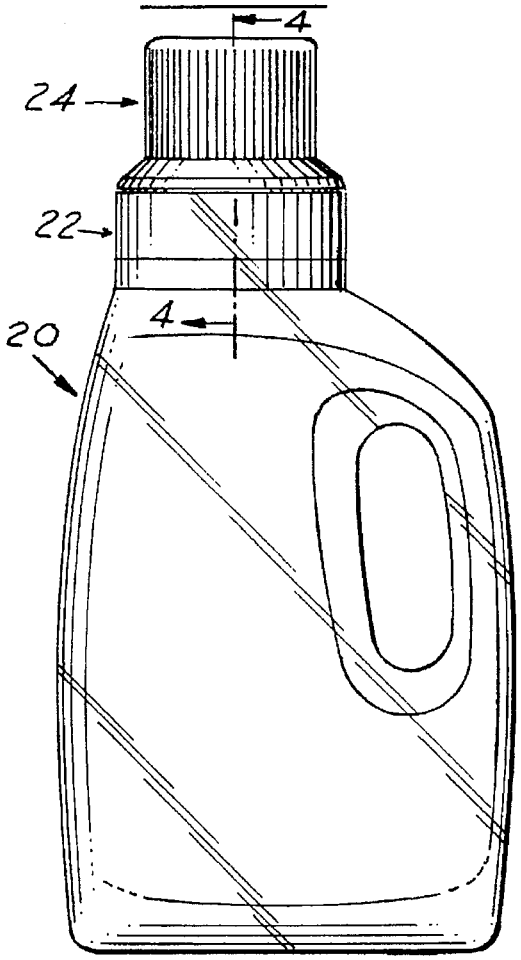
FIG. 1 is a side elevational view of a combined liquid containing and dispensing package embodying the invention.

Referring to FIG. 1 the combined liquid containing and dispensing the package embodying the invention comprises a hollow blow molded plastic container 20 that includes a spout insert 22 and a combined dispensing cup and closure 24.

Figure 4:
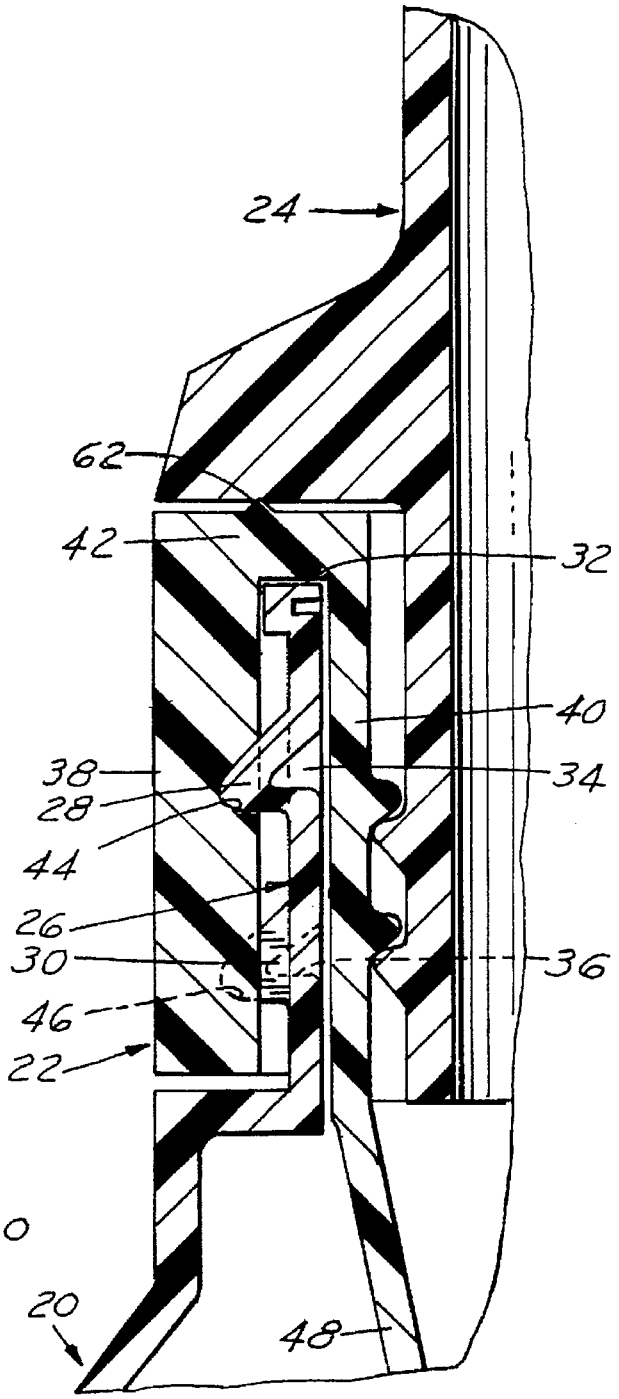
FIG. 4 is a fragmentary sectional view on a greatly enlarged scale showing a portion of the package taken on the line 4—4 in FIG. 1.
Figure 5:
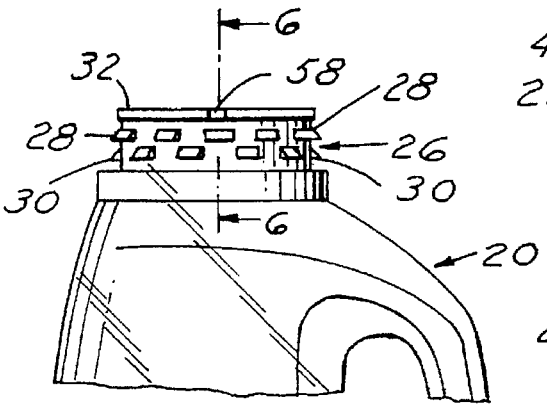
FIG. 5 is a fragmentary view of a portion of the container.
Figure 2:
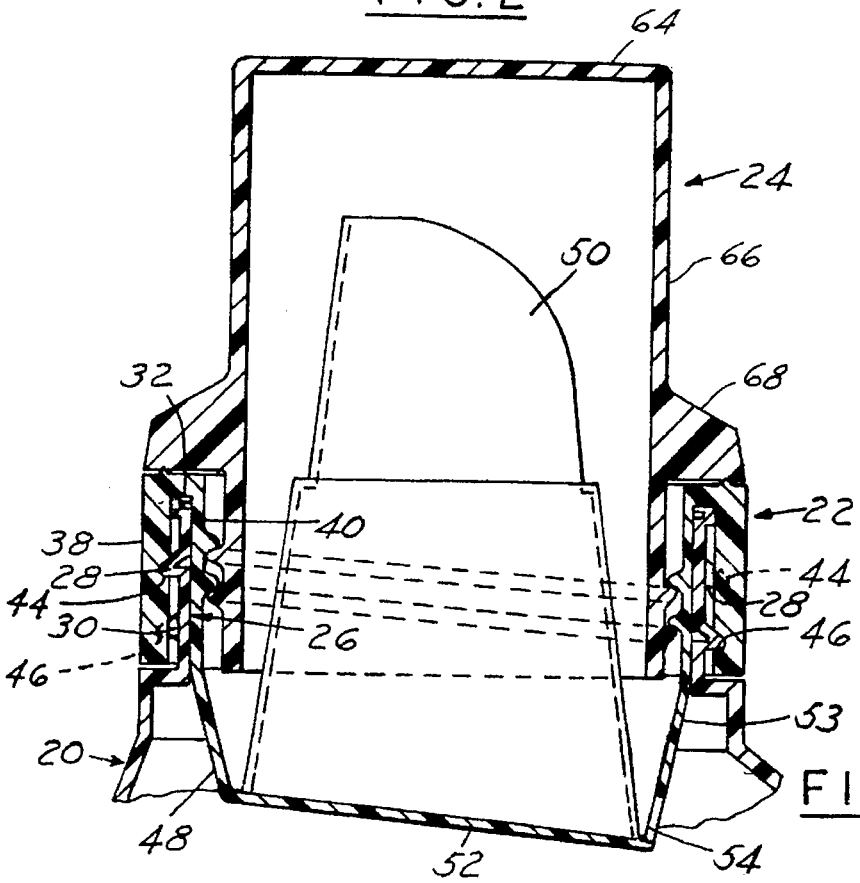
FIG. 2 is a fragmentary sectional view taken along the line 2—2 in FIG. 3.
Figure 6:
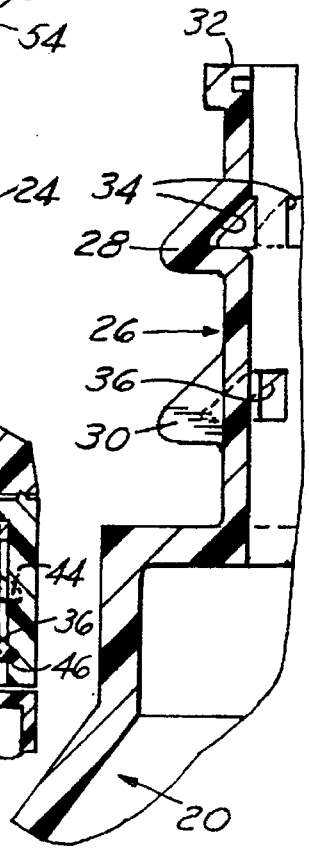
FIG. 6 is a sectional view taken along the lines 6—6 in FIG. 5.
Figure 3:
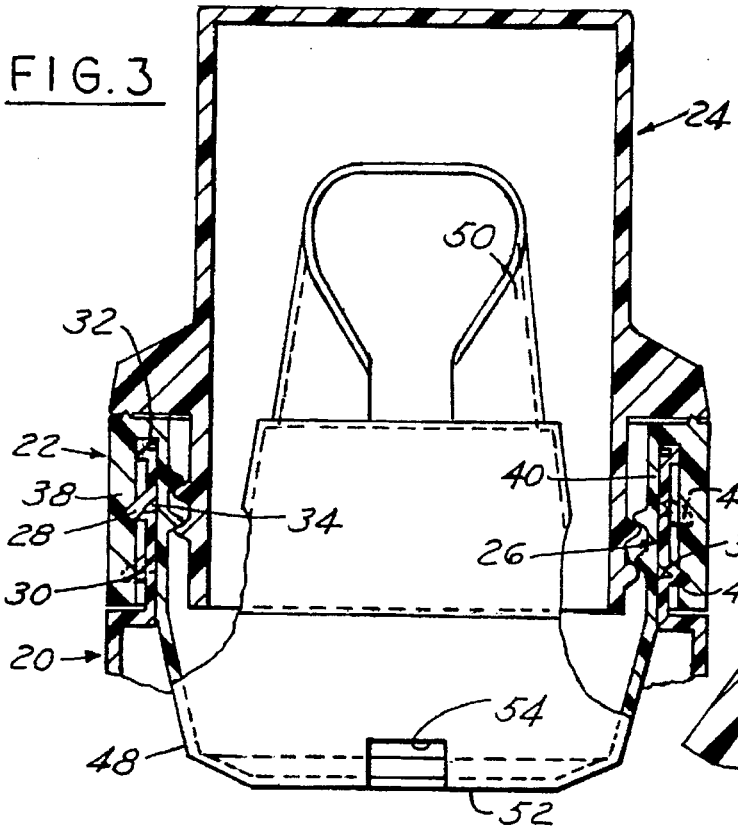
FIG. 3 is a fragmentary sectional view taken along the line 3—3 in FIG. 2.
Figure 7:
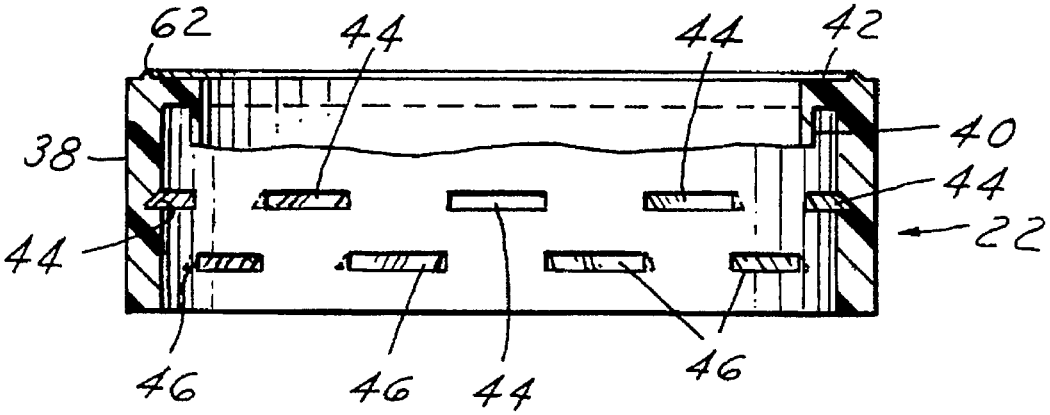
FIG. 7 is a fragmentary sectional view on an enlarged scale of a the portion of the spout insert.
Figure 8:
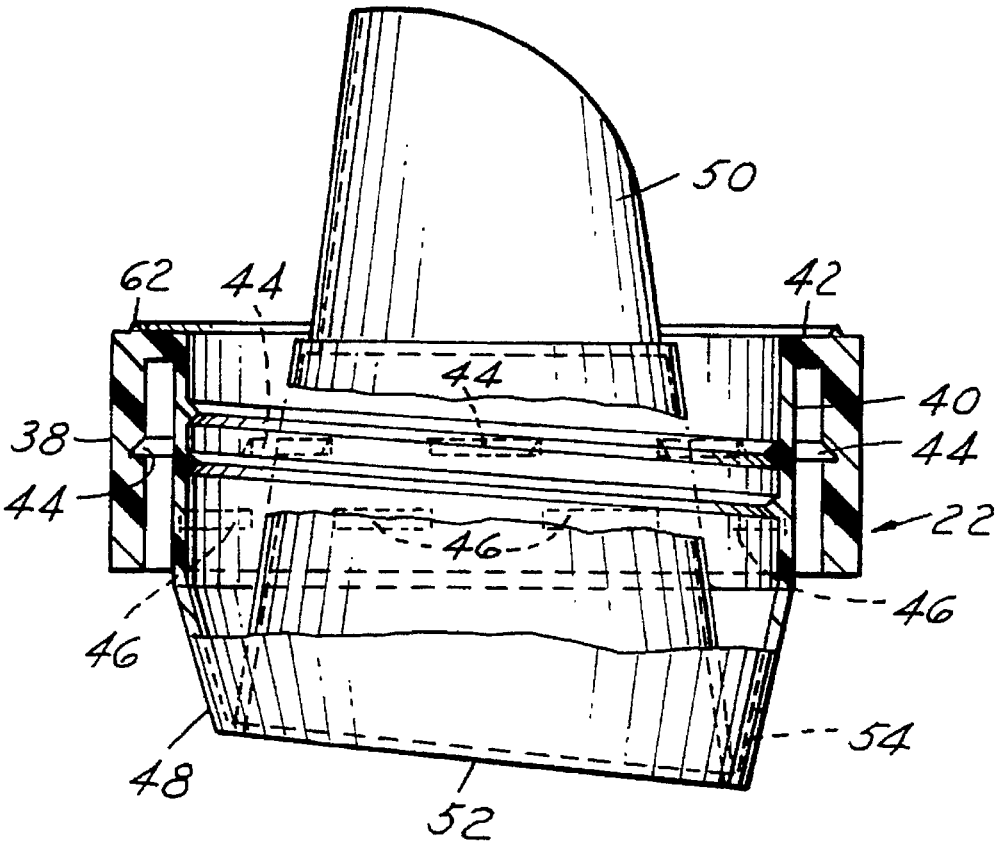
FIG. 8 is a fragmentary sectional view on an enlarged scale of the spout insert.

As shown in FIGS. 2–8, the plastic container 20 has a finish 26 with an integrally formed series of lugs 28, 30 in two rows (FIG. 5) and a flat top sealing surface 32. Lugs 28 are staggered circumferentially with respect to lugs 30. As shown in FIG. 4, the lugs 28, 30 are formed by being blown outwardly so that complimentary recesses 34, 36 are provided on the inner surface of the finish.

The spout insert 22 includes an outer wall 38 and an inner wall 40 combined by an integral transverse wall 42. The outer wall 38 is formed with two axially spaced rows of recesses 44, 46 that are complementary to and engage the lugs 28, 30 by a snap action to orient the spout insert 22 circumferentially. Such a construction also permits the assembly of the insert 22 to the container 20 at high speeds of assembly.

The inner wall 40 of the spout insert 22 includes a lower portion 48 that is connected to a spout portion 50 by an inclined bottom portion 52. The lower portion 48 of the spout insert 22 is provided with axially spaced opening 54. The spout insert 22 is further provided with a sealing rib 62 on the upper surface of transverse wall 42.

The combined measuring cup and closure is substantially identical to the disclosures shown in U.S. Pat. No. 4,917,269 and includes a base wall 64 and a depending annular peripheral wall 66. A radial flange 68 is provided intermediate the base wall on the lower edge of the wall 36 and external threads are provided below the flange. A primary flexible sealing ring is provided on the outer surface of the lower portion of the wall of the closure and extends at an angle outwardly and upwardly from the outer surface of the wall.

It can thus be seen that there has been provided a liquid containing and dispensing package wherein the package can be easily assembled; wherein the part forming the spout can be inserted in the container and held in place utilizing various attaching methods; wherein the portion forming the spout can be pushed in and snapped in to place on the container; wherein the spout is radially prevented from rotating relative to the container, being removed from the container or taken off of the container by over-tightening of the closure; and where the combined measuring cup and closure seals against the spout and the spout seals against the container.

What is claimed is:

1. A liquid container and dispensing package comprising a plastic container having a finish defining an opening, said finish having an outer surface and an inner surface, a plastic spout insert, said spout insert having an annular outer wall, an annular inner wall defining a spout and an integral portion connecting said annular walls, said annular outer wall of said spout insert having an inner surface, interengaging means between said container and said spout insert comprising circumferentially spaced lugs and complementary spaced recesses for providing a snap fit during assembly and preventing rotation between said spout insert and said container, said annular inner wall of said spout insert having an inner surface formed with a spiral thread, said spout insert including an axially extending spout connected to the lower edge of said annular inner wall and extending above said annular inner wall, a combined measuring cup and closure comprising an annular axial wall, a base wall and a radial flange intermediate the base wall and lower end of said axial wall, said portion of said axial wall of said combined cup and closure beneath said flange including thread means on the outer surface thereof engaging said spiral thread on said annular inner wall of said insert, said interengaging means comprises an annular row of complementary lugs and recesses, said lugs being on the outer surface of said finish and said recesses are on said inner surface of said outer wall of said spout insert, said lugs comprising at least two annular rows of circumferentially spaced lugs on the outer surface of said finish, said lugs in one row being staggered circumferentially with respect to the lugs of an adjacent row.

2. The liquid containing and dispensing package set forth in claim 1 wherein said spiral thread on the inner surface of said spout insert comprises a groove.

3. The liquid containing and dispensing package set forth in claim 2 wherein said lugs on said finish are formed by blow molding such that there are recesses on the inner surface of said finish.

4. The liquid containing and dispensing package set forth in claim 3 including a drain-back opening in said insert.

5. A liquid dispensing container and insert package comprising a plastic container having a finish defining an opening, said finish having an outer surface and an inner surface, a plastic insert, said insert having an annular outer wall, an annular inner wall and an integral portion connecting said annular walls, said annular outer wall of said insert having an inner surface, said inner surface of said annular outer wall of said insert having means thereon for interengaging said means on said outer surface of said finish being constructed and arranged to prevent relative rotation between the finish and the insert, said interengaging means comprising complementary circumferentially spaced lugs and circumferentially spaced recesses, said annular inner wall of said insert having an inner surface formed with a spiral thread adapted to engage a thread on a combined cup and closure, said insert including an axially extending spout connected to the lower edge of said annular inner wall and extending above said annular inner wall of said combined cup and closure, said lugs being on the outer surface of said finish and said recesses being on said inner surface of said outer wall of said spout insert, said lugs comprising at least two annular rows of circumferentially spaced lugs on the outer surface of said finish, said lugs in one row being staggered circumferentially with respect to the lugs of an adjacent row.

6. The liquid container and insert package set forth in claim 5 wherein said spiral thread on the inner surface of said spout insert comprises a groove.

7. The liquid container and insert package set forth in claim 6 wherein said lugs on said finish are formed by blow molding such that there are recesses on the inner surface of said finish.

8. The liquid container and insert package set forth in claim 7 including a drain-back opening in said insert.

9. For use in a dispensing package comprising a plastic container having a finish defining an opening, said finish having an outer surface and an inner surface, said outer surface of said finish having means thereon for engaging an insert, the improvement comprising a plastic spout insert, said insert having an annular outer wall, an annular inner wall and an integral portion connecting said annular walls, said outer wall of said insert having an inner surface, said inner surface of said outer wall of said insert having circumferentially spaced lugs thereon for engaging complementary recesses on a finish of a container for providing a snap fit during assembly and for preventing rotation between said spout insert and a container, said annular inner wall of said spout insert having an inner surface formed with a spiral thread groove, said insert including an axially extending spout connected to the lower edge of said annular inner wall and extending above said annular inner wall, a combined measuring cap and closure comprising an annular axial wall and a base wall and a radial flange intermediate the base wall and lower end of said axial wall, said portion of said axial wall of said combined cup and closure beneath said flange including thread means on the outer surface thereof engaging said spiral thread groove on said annular inner wall of said insert, said lugs being provided in an annular row, said lugs being provided in annular rows, the lugs in one row being staggered circumferentially with respect to the lugs in the adjacent row.

10. The plastic insert and combined measuring cap and closure set forth in claim 9 including a drain-back opening in said insert.

11. The plastic insert and combined measuring cup set forth in claim 10 wherein said spiral thread on said insert comprises a groove.

12. For use in a dispensing package comprising a plastic container having a finish defining an opening, said finish having an outer surface and an inner surface, said outer surface of said finish having means thereon for engaging an insert, the improvement comprising a plastic insert, said insert having an annular outer wall, an annular inner wall and an integral portion connecting said annular walls, said outer wall of said insert having an inner surface, said inner surface of said outer wall of said insert having circumferentially spaced lugs thereon for engaging complementary recesses on a finish of a container for providing a snap fit during assembly and for preventing rotation between said spout insert and a container, said annular inner wall of said insert having an inner surface formed with a spiral thread receiving groove, said insert including an axially extending spout connected to the lower edge of said annular inner wall and extending above said annular inner wall, said lugs being provided in an annular row, said lugs being provided in annular rows, the lugs in one row being staggered circumferentially with respect to the lugs in the adjacent row.

13. The plastic insert set forth in claim 12 wherein said spiral thread on said insert comprises a groove.

14. The plastic insert set forth in claim 13 including a drain-back opening in said insert.

15. A liquid dispensing container and insert package comprising a plastic container having a blow molded finish defining an opening, said finish having an outer surface and an inner surface, a plastic insert, said insert having an annular outer wall, an annular inner wall and an integral portion connecting said annular walls, said annular outer wall of said insert having an inner surface, said inner surface of said annular outer wall of said insert having means thereon for interengaging said means on said outer surface of said finish being constructed and arranged to prevent relative rotation between the finish and the insert, said interengaging means comprising complementary circumferentially spaced blow molded lugs and circumferentially spaced recesses, said lugs comprising at least two annular rows of circumferentially spaced lugs on the outer surface of said finish, said lugs in one row being staggered eircumferentially with respect to the lugs of an adjacent row, said annular inner wall of said insert having an inner surface formed with a spiral thread adapted to engage a thread on a combined cup and closure, said insert including an axially extending spout connected to the lower edge of said annular inner wall and extending above said annular inner wall of said combined cup and closure, said lugs being on the outer surface of said finish and said recesses being on said inner surface of said outer wall of said spout insert.

16. The liquid container and insert package set forth in claim 15 wherein said spiral thread on the inner surface of said spout insert comprises a groove.

17. The liquid container and insert package set forth in claim 16 wherein said lugs on said finish are formed by blow molding such that there are recesses on the inner surface of said finish.

18. The liquid container and insert package set forth in claim 17 including a drain-back opening in said insert.

* * * * *